United States Patent [19]

Hamaguchi

[11] 3,937,256

[45] Feb. 10, 1976

[54] APPARATUS FOR MANUFACTURING CORNER SPRINGS

[75] Inventor: Yoshiharu Hamaguchi, Fussa, Japan

[73] Assignee: France Bed Co., Ltd., Tokyo, Japan

[22] Filed: June 9, 1975

[21] Appl. No.: 585,033

[52] U.S. Cl. ..... 140/71 R; 140/1

[51] Int. Cl.[2] ..... B21F 35/00

[58] Field of Search ..... 140/1, 71 R

[56] References Cited

UNITED STATES PATENTS

| | | | |
|---|---|---|---|
| 3,245,433 | 4/1966 | Taylor | 140/71 |
| 3,438,237 | 4/1969 | Sisler | 140/71 |
| 3,872,896 | 3/1975 | Yoshimura | 140/71 |

*Primary Examiner*—Lowell A. Larson

[57] ABSTRACT

An apparatus for manufacturing corner springs which comprises a pair of spring leg-forming mechanisms for folding both ends of a wire several times to provide spring legs at said ends; a pair of heat-treating devices for heat-treating a wire having spring legs formed at both ends; and a pair of spring leg-bending mechanisms for bending the heat-treated spring legs.

11 Claims, 15 Drawing Figures

APPARATUS FOR MANUFACTURING CORNER SPRINGS

BACKGROUND OF THE INVENTION

This invention relates to an apparatus for manufacturing corner springs used with the spring structure of a mattress. The spring structure of a mattress is constructed by folding both ends of a plurality of wires 11 several times, as illustrated in FIG. 1, to form spring legs 12 at said ends, and bending the spring legs 12 in such direction as causes the spring legs 12 to be aligned with the corner sections of the spring structure. These spring legs 12 are used with the spring structure to prevent the corner sections thereof from being deformed and also to reinforce said corner sections.

SUMMARY OF THE INVENTION

The object of this invention is to provide an apparatus for automatically manufacturing the above-mentioned corner springs of the mattress spring structure. The apparatus of this invention for manufacturing said corner springs comprises a pair of wire-folding mechanisms for folding both ends of a wire several times to provide spring legs at said ends; a pair of heat-treating devices for heat-treating a wire having spring legs formed at both ends; and a pair of spring leg-bending mechanisms for bending the heat-treated spring legs.

BRIEF DESCRIPTION OF THE DRAWING

FIGS. 2 to 12 jointly indicate the various divisions of a corner spring-manufacturing apparatus according to an embodiment of this invention:

FIG. 3 is a side view of the whole apparatus;

FIG. 4 is a side view of the wire-clamping section of a spring-forming mechanism;

FIG. 5 is a plan view of the wire-folding device of the spring leg-forming mechanism;

FIG. 6 is a side view of the wire-folding device of the spring leg-forming mechanism;

FIG. 7 is a plan view of the heat-treating device of the subject apparatus;

FIG. 8 is a front view of said heat-treating device;

FIG. 9 is a side view of said heat-treating device;

FIG. 10 is a plan view of a spring leg-bending mechanism;

FIG. 11 is a front view of said spring leg-bending mechanism; and

FIG. 12 is a side view of said spring leg-bending mechanism;

DETAILED DESCRIPTION OF THE INVENTION

Figure 2A:
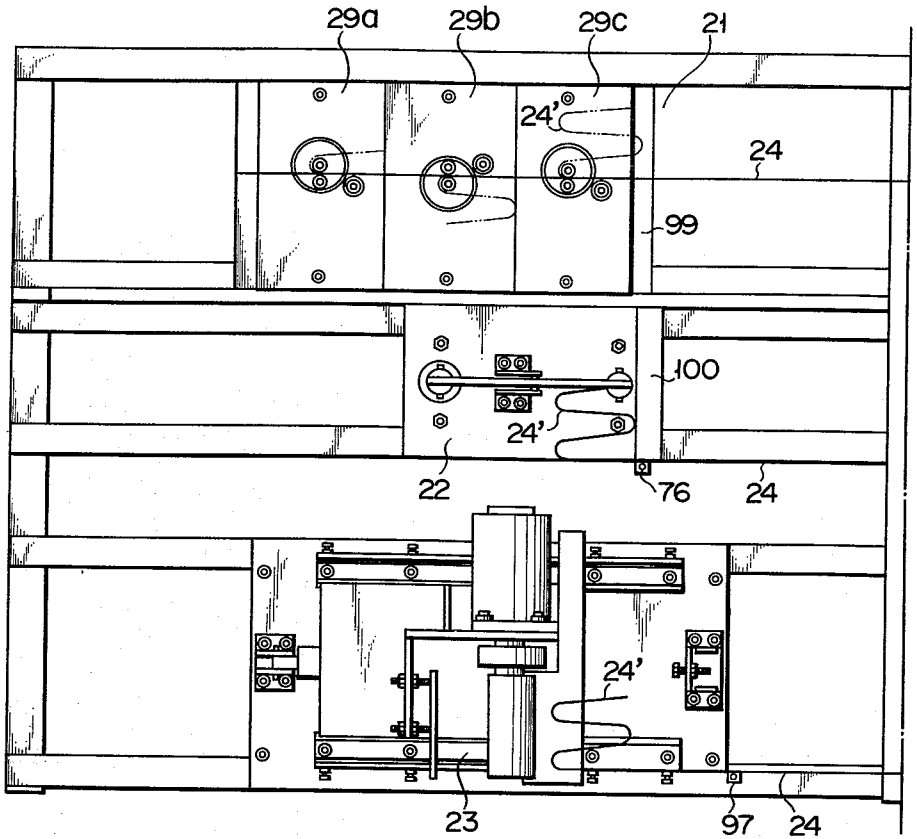
FIGS. 2A and 2B are a plan view of the whole apparatus.
Figure 2B:
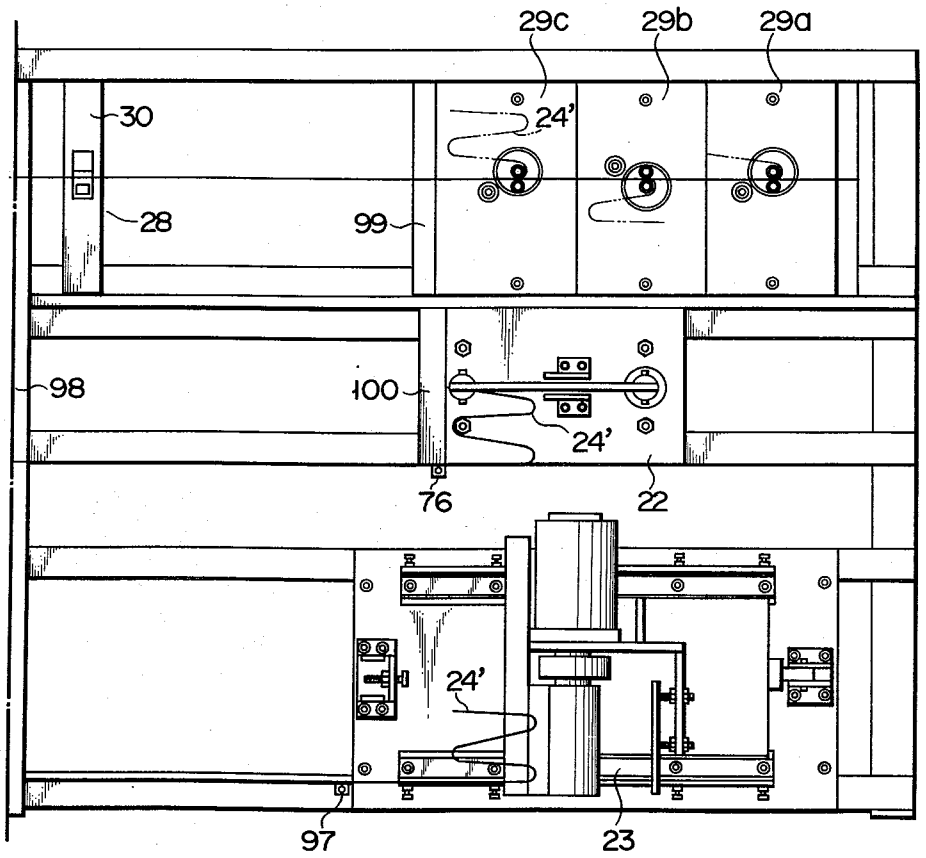
Figure 3:
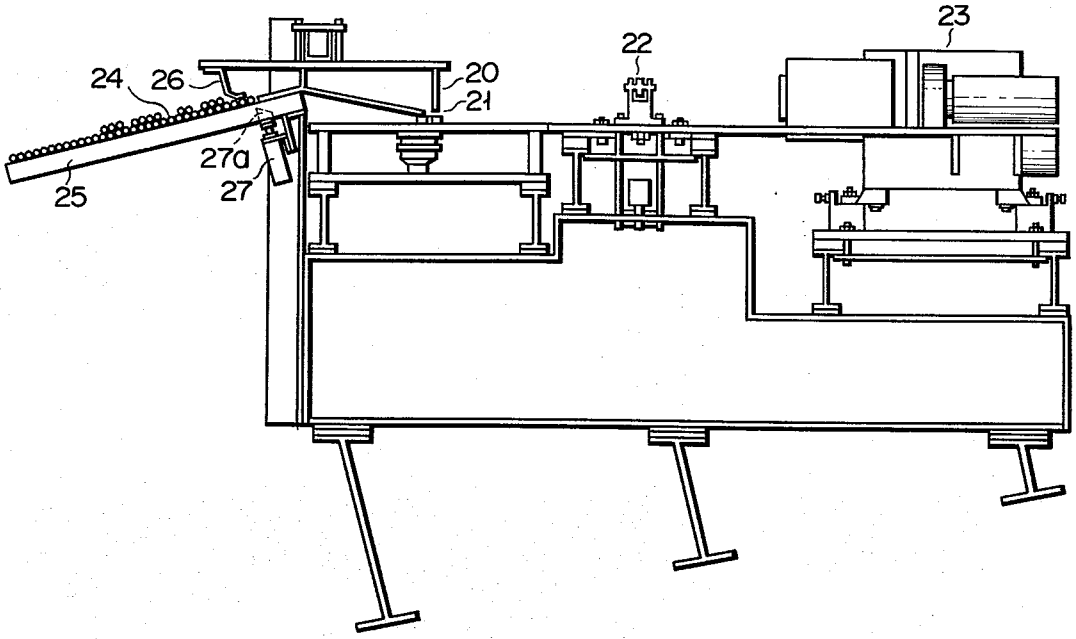
Figure 13:
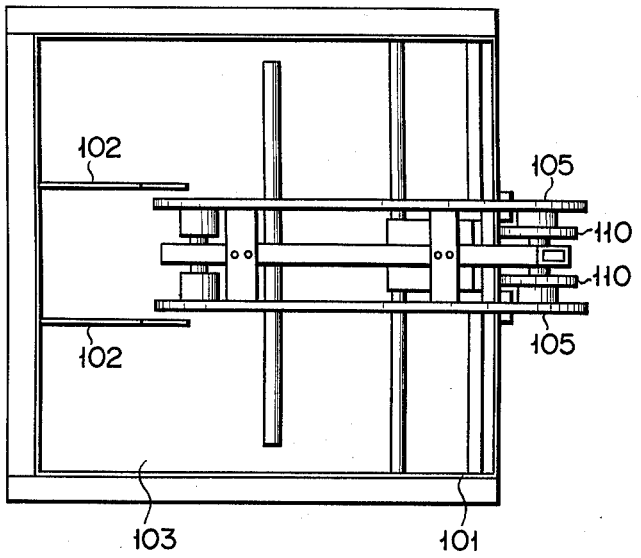
FIG. 13 is a plan view of a wax-applying device.
Figure 14:
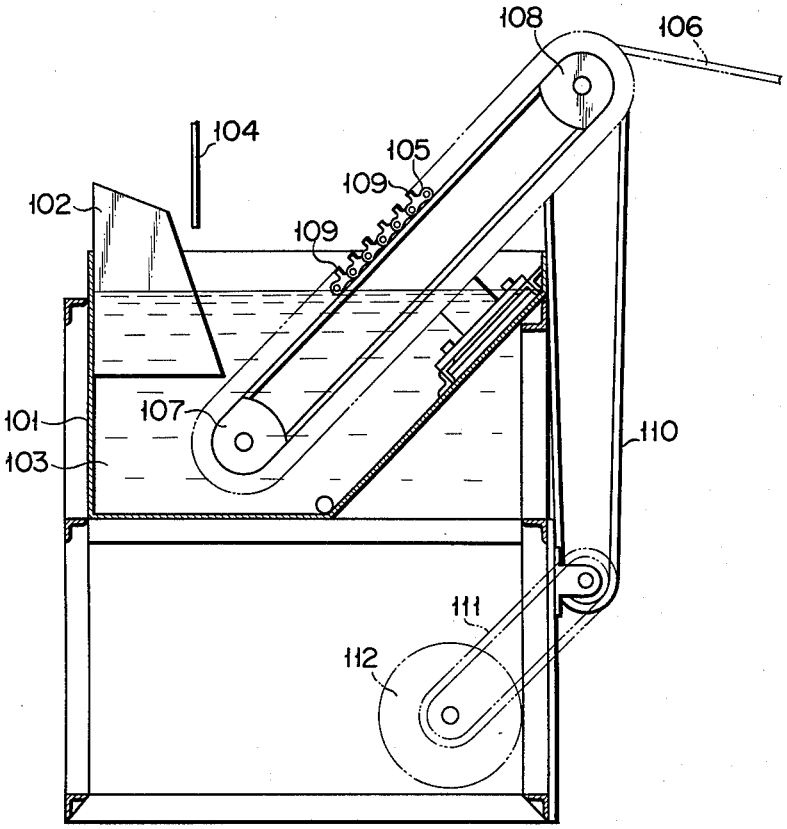
FIG. 14 is a side view of said wax-applying device.

There will now be described with reference to the appended drawings a corner spring-manufacturing apparatus according to an embodiment of this invention. FIG. 2 is a plan view of the main part of the subject apparatus and FIG. 3 is a side view thereof. As seen from these figures, the main part of the subject apparatus comprises a spring leg-forming mechanism 21, a heat-treating device 22 and a spring leg-bending mechanism 23. All these processing divisions 21, 22, 23 are arranged in the order mentioned as counted from that side of the subject apparatus to which a corner spring wire 24 is supplied. If necessary, a wax-applyiing device 101 shown in FIGS. 13 and 14 is provided after the spring leg-bending mechanism 23. A plurality of wires 24 are first brought one after another at right angles to the spring leg-forming mechanism 21 at a prescribed time interval. Each wire 24 has its shape put in order by passing, as shown in FIG. 3, between a feed table 25 and a spacing attachment 26. When a cylinder 27 is operated, a lifting member **27*a* whose top plane is inclined downward toward the spring leg-forming mechanism 21 moves vertically to feed one wire each time to said mechanism 21. The wire-feeding mechanism, spring leg-forming mechanism 21, heat-treating device 22, and spring leg-bending mechanism 23 are built on the floor in a cascade fashion in the order mentioned. The wire 24 gravitationally rolls down to the spring leg-forming mechanism 21, the heat-treating device 22** and spring leg-bending mechanism in succession.

Figure 4:
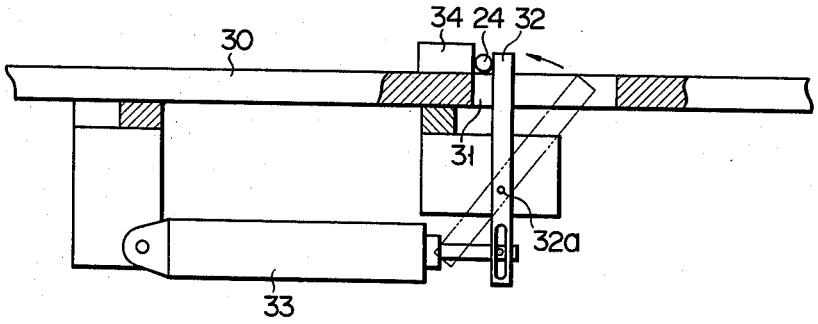

The spring leg-forming mechanism 21 comprises a pair of wire-folding devices 29 adjustably spaced from each other according to the length of a wire 24 being processed, and a wire-clamping means 28 placed between said wire-folding devices 29. The wire-clamping means 28 is constructed as shown in FIG. 4. Namely, this wire-clamping means 28 has an upper plate 30 bored with a penetrating hole 31 and a swingable lever 32 which swings toward the wire 24 through the penetrating hole 31 with the upper end of the lever 32 positioned above the upper plate 30. The lower end of the swingable lever 32 is fitted with a cylinder 33 for driving said lever 32. The piston of the cylinder 33 causes the lever 32 to swing about a pivotal shaft **32*a*. A wall 34 is erected on the upper plate 30 at such a point as faces the projecting upper end of the swung lever 32. When the lever 32 is swung upright by the action of the cylinder 33, then the intermediate portion of the wire 24 is clamped between the wall 34 and the upper end of the lever 32**.

Figure 5:
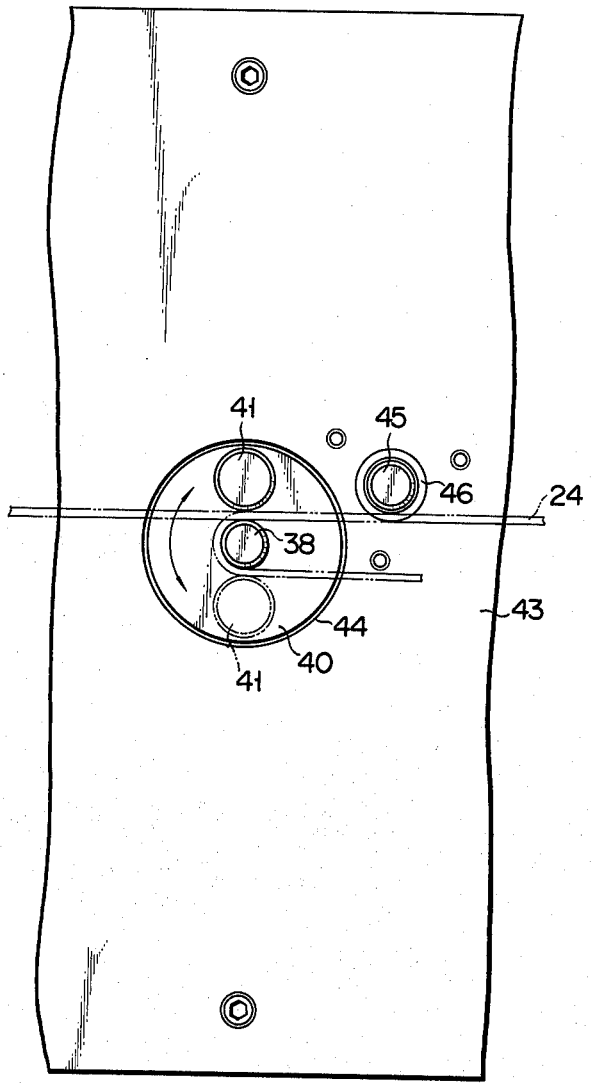
Figure 6:
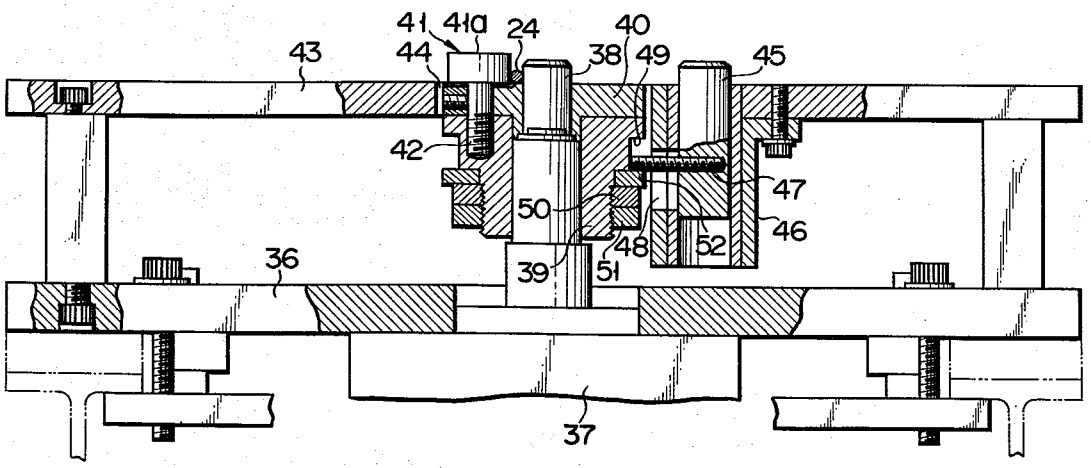

There will now be described by reference to FIGS. 5 and 6 one of the paired wire-folding devices 29 provided on both sides of the wire-clamping means 28 which consists of three wire-folding units **29*a*, 29*b*, 29*c* linearly arranged in the axial direction of the wire 24. A base plate 36 (FIG. 6) is fitted with a drive device 37. The upper portion of a rotatable vertically moving shaft 38 operated by said drive device 37 projects above the base plate 36. A cylindrical member 39 is fixed to the periphery of the rotatable vertically moving shaft 38. A circular receiver plate 40 is mounted on the cylindrical member 39. The upper end of said shaft 38 passes upward through the central portion of the receiver plate 40. A wire-folding member 41 provided with a projection 41*a* is fitted to the receiver plate 40 slightly apart from the central portion thereof. The projection 41*a* of the wire-folding member 41 is positioned on the receiver plate 40, and the lower part of the wire-folding member 41 penetrates the receiver plate 40 to be fixed to the cylindrical member 39 by a screw 42 passing through the receiver plate 40. Thus the receiver plate 40 is fixed to the cylindrical member 39 by the wire-folding member 41 and screw 42. The receiver plate 40 is lifted through the penetrating hole 44 of the upper plate 43 together with the shaft 38 of the drive device 37 and cylindrical member 39 and, when fully lifted, is set flush with the surface of the upper plate 43. The upper plate 43 is so positioned as to face the base plate 36. Aside of the wire folding member 41 is disposed a wire-contacting shaft 45, which is slidably held in a supporting cylinder 46 fixed to the upper plate 43. An interlocking shaft 47 is fixed at one end to the wire-contacting shaft 45 to move it vertically simultaneously with the similar movement of the cylindrical member 39. The other end of the interlocking shaft 47 passes through an elongate hole 48 to project toward the cylindrical member 39 and is further disposed between a stepped portion 49 formed on the periphery of the cylindrical member 39 and an engagement ring 52 fixed to the periphery of the cylindrical member 39 by means of tightening rings 50, 51. The cylindrical member 39 is moved upward in abutment with the stepped portion 49 and downward in contact with the engagement ring 52, thereby effecting the simultaneous movement in both ways of the wire-contacting shaft 45**.

Figure 1:
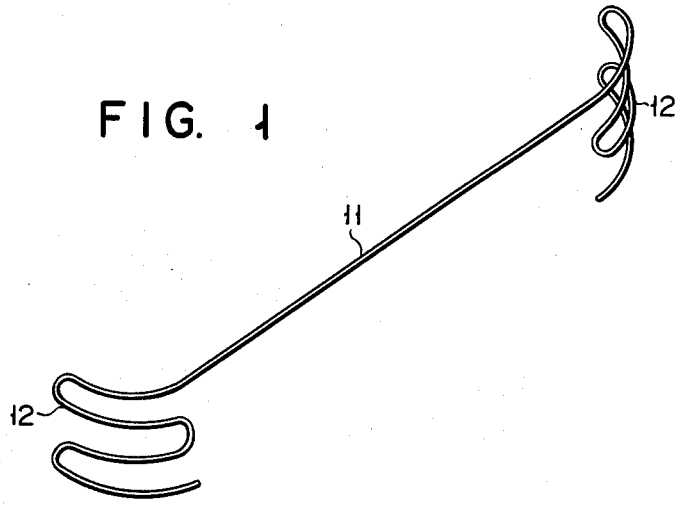
FIG. 1 is an oblique view of corner springs formed at both ends of a wire.

A linear wire 24 which has gravitationally rolled off the feed table 25 to be supplied to the spring leg-forming mechanism 21 is first brought into contact with a stop member 20 and then clamped between the upper end of the rotatable vertically moving shaft 38 and the projection 41*a* of the wire-folding member 41. When the shaft 38 is rotated through a prescribed angle by the drive device 37, then the cylindrical member 39 and receiver plate 40 rotate jointly with the shaft 38. As the result, the projection 41*a* of the wire-folding member 41 on the receiver plate 40 is rotated through a prescribed angle. Rotation of the projection 41*a* causes the end portion of the wire 24 clamped between said projection 41*a* and shaft 38 to be folded, for example, through an angle of about 180° starting with the clamped portion. In this case, the wire-contacting shaft 45 prevents the central portion of the wire 24 from being flexed. Each of the paired wire-folding devices 29 consists of three wire-folding units 29*a*, 29*b*, 29*c* linearly arranged in the axial direction of the wire 24. Referring to one of the paired wire-folding devices 29 shown, for example, on the left side of FIG. 2, the three wire-folding units 29*a*, 29*b*, 29*c* constituting said wire-folding device 29 which are linearly arranged in the order mentioned as counted from the left end of the corner spring-manufacturing apparatus are put into operation in succession. Namely, one end of the wire 24 is clockwise folded through an angle of almost 180° by the wire-folding unit 29*a*, counterclockwise folded through an angle of almost 180° by the wire-folding unit 29*b* and clockwise folded through an angle of almost 180° by the wire-folding unit 29*c*. On the other hand, the three wire-folding units 29*a*, 29*b*, 29*c* constituting the wire-folding device on the right side of the aforesaid apparatus carry out the folding of the wire 24 in exact symmetry. Namely, the other end of the wire 24 is first counterclockwise folded by the wire-folding unit 29*a*, clockwise folded by the wire-folding unit 29*b* and finally counterclockwise folded by the wire-folding unit 29*c*, in all cases through an angle of almost 180°. Thus, a spring leg 24' consisting of, for example, three foldings of the wire 24 is provided at both ends thereof, as illustrated in FIG. 1. Before the second folding of the wire 24 is carried out by the wire-folding unit 29*b* after completion of the first folding of the wire 24 by the wire-folding unit 29*a*, it is necessary to remove the wire from between the rotatable vertically moving shaft 38 of the drive device 27 and the projection 41*a* of the wire-folding member 41. To this end, said shaft 38 descends to its original position by being rotated in the opposite direction, causing the cylindrical member 39, receiver plate 40 and projection 41*a* to be brought down simultaneously so as to remove the wire 24 from between said shaft 38 and projection 41*a*. At this time, the interlocking shaft 47 is pushed downward by the stepped portion 49 of the cylindrical member 39, and in consequence the wire-contacting shaft 45 is also let to fall so as to set the upper end portion thereof apart from the side of the wire 24. The above-mentioned descent of the associated members also takes place in the wire-folding units 29*b*, 29*c*. The descent of the associated members of all the three wire-folding members 29*a*, 29*b*, 29*c* is repeated until the spring leg 24' is fully formed. Upon receipt of a signal denoting the completed formation of said spring leg 24', the rotatable vertically moving shaft 38 is lifted ready for the folding of a succeeding wire 24. When the three-times folding of the wire 24 at both ends thereof is brought to an end at the wire-folding unit 29*c*, then the shaft 38 and the projection 41 are brought down. The wire 24 which is now not held by any engaging member gravitationally rolls down to the succeeding heat-treating device 22. Where it is desired to form a spring leg 24' of a larger number of wire foldings, it is advised to provide more wire-folding units accordingly.

Figure 7:
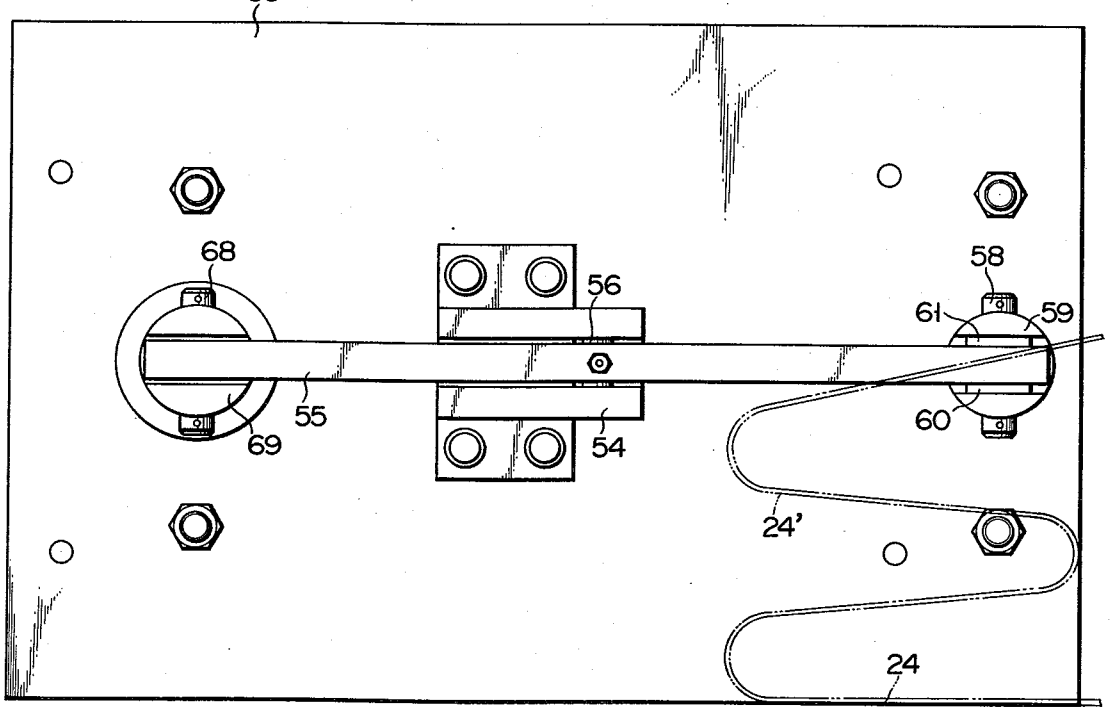
Figure 8:
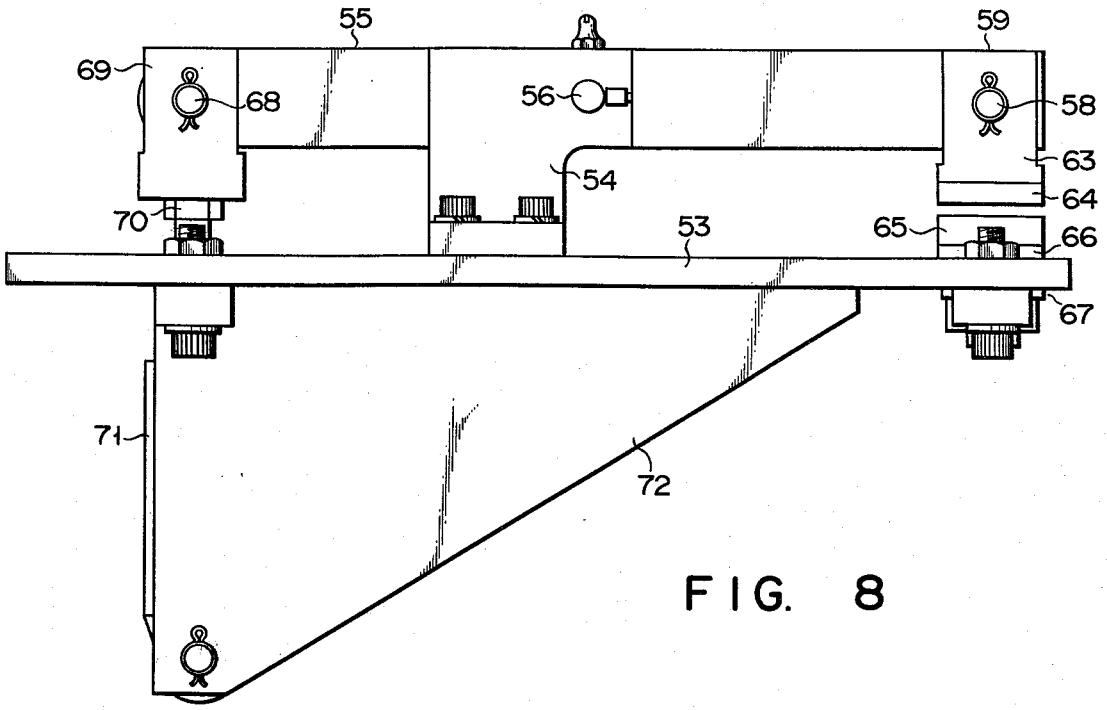
Figure 9:
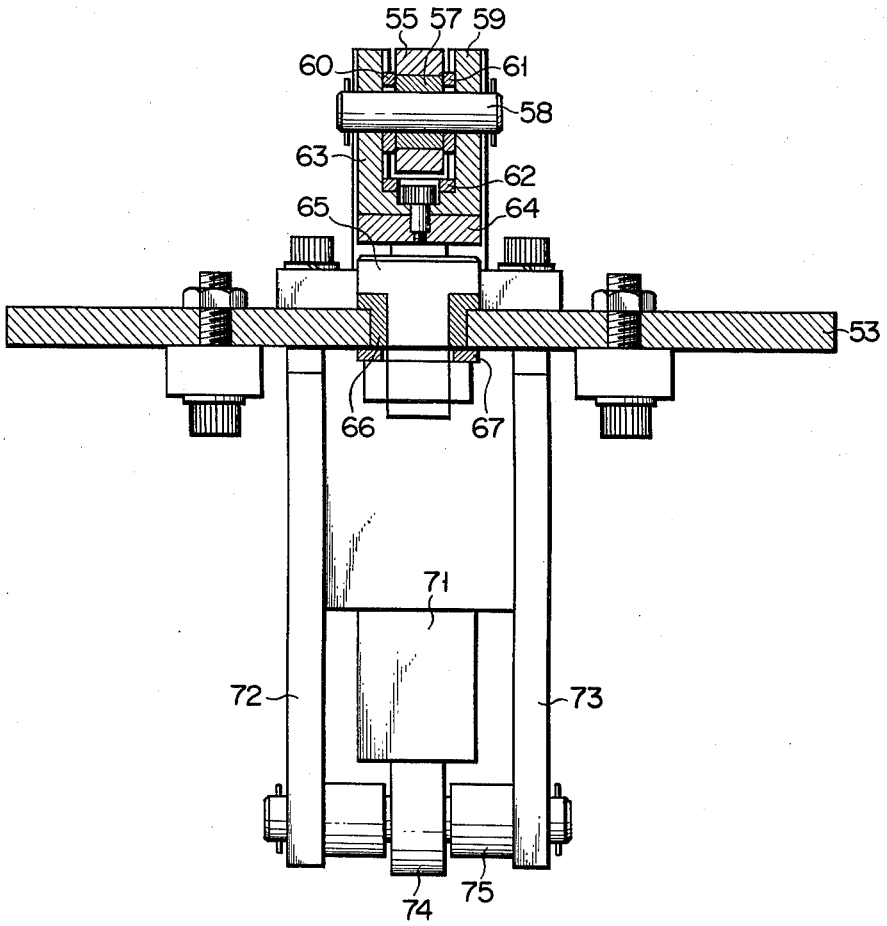

There will now be described by reference to FIGS. 7 to 9 one of a pair of heat-treating devices 22. A wire-folding member 54 is mounted on an upper plate 53. A swingable rod 55 is supported on the wire-folding member 45 by means of a pivotal shaft 56. A shaft 58 penetrates an insulation member 57 (FIG. 9) at one vertically moving end of the swingable rod 55. A movable electrode 59 is supported on the shaft 58 with insulation members 60, 61, 62 disposed between said electrode 59 and swingable rod 55. In this case, the movable electrode 59 consists of its body 63 and a detachable member 64 disposed below said body 63. A stationary electrode 65 is fixed on the upper plate 53 so as to face the underside of the movable electrode 59. Insulation members 66, 67 are provided between the upper plate 53 and stationary electrode 65. An operable member 69 is fitted to the other end of the swingable rod 55 by a penetrating shaft 68. A cylinder 71 is disposed below said operable member 69. A movable member 70 driven by said cylinder 71 is pressed against the underside of the operable member 69. The movable member 70 of the cylinder 71 causes the other end of the swingable rod 55 to be swung upward together with the operable member 69. The cylinder 71 has its lower end portion supported by a shaft 75 between a pair of support plates 72, 73.

The spring leg 24' brought to the heat-treating device 22 constructed as described above has its end placed between the movable electrode 59 and stationary electrode 65 provided at one end of the swingable rod 55. Thereafter when the cylinder 71 is lifted, the movable member 70 thereof pushes the operable member 69, causing the other end of the swingable rod 55 to be swung upward, and in consequence said one end thereof to be brought down. As the result, the end of the spring leg 24' is clamped between the movable electrode 59 and stationary electrode 65. At this time, electric current is introduced through the wire 24 for heat treatment. The spring leg 24' is held between the movable electrode 59 and stationary electrode 65 of each of the paired heat-treating devices 22. A common power source is connected to the paired movable electrodes 59. Each heat-treating device 22 is provided with a stop member 76 to bring the wire 24 to rest at a prescribed position. Upon completion of heat treatment, the stop member 76 is released from the wire 24, causing the spring leg 24' to be gravitationally brought down to the spring leg-bending mechanism 23.

Figure 10:
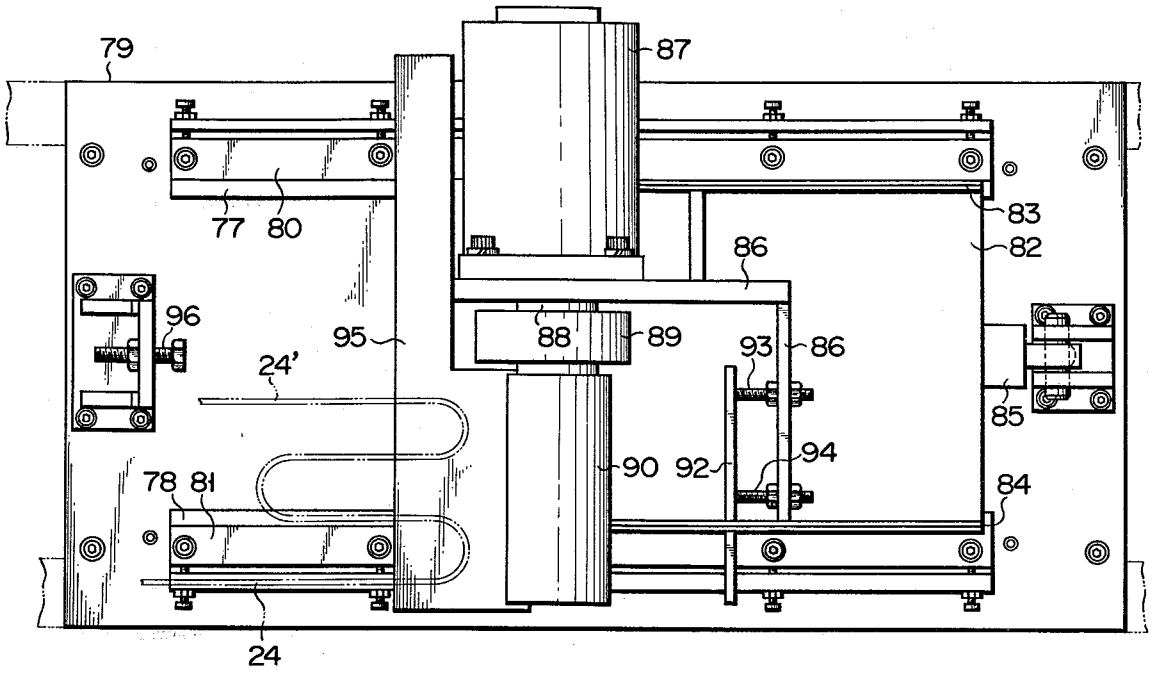
Figure 11:
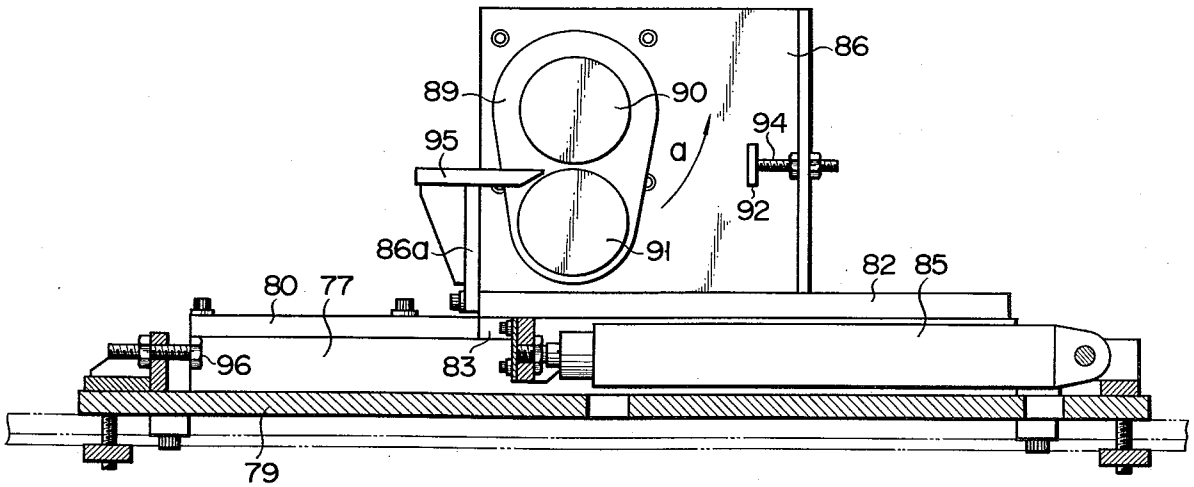
Figure 12:
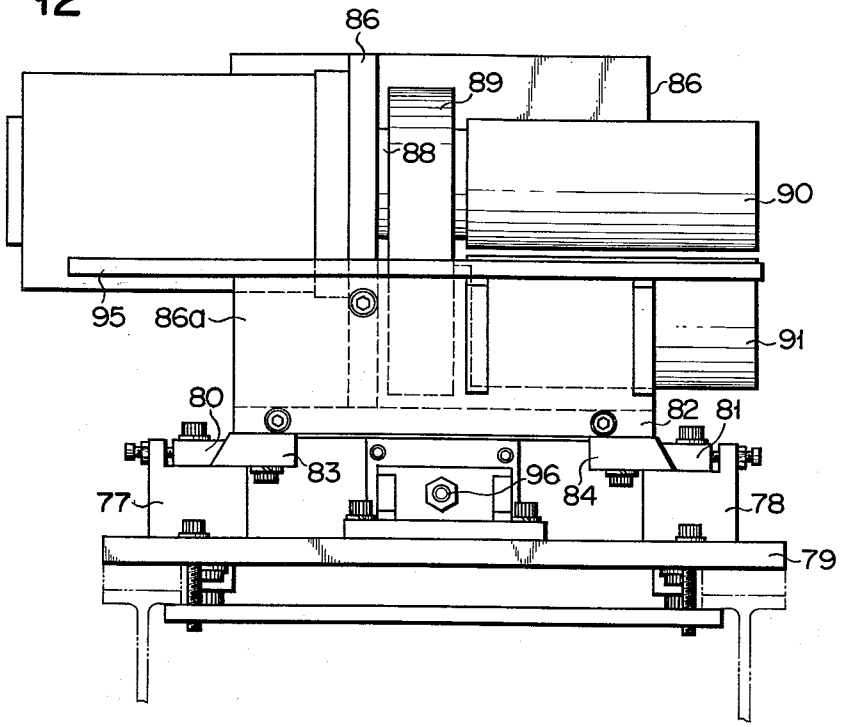

Like the heat-treating devices 22, the spring leg-bending mechanisms 23 are horizontally provided in pairs on both sides of the subject corner spring-manufacturing apparatus. There will now be described with reference to FIGS. 10 to 12 one of the paired spring leg-bending mechanisms 23. A pair of parallel support rails 77, 78 are laid lengthwise of a stationary plate 79. A pair of parallel guide rails 80, 81 are mounted on said support rails 77, 78. A pair of parallel slide rails 83, 84 are fixed to the underside of a side plate 82. The slide rails 83, 84 are supported on the support rails 77 in engagement with the guide rails 80, 81. This arrangement enables the slide plate 82 to slide lengthwise of the spring leg-bending mechanism 23 while being guided by the guide rails 80, 81. A drive cylinder 85 is connected to the slide plate 82. An upward projecting support plate 86 is set up on the slide plate 82. This projecting support plate 86 is fitted with a rotatable drive device 87, the rotary shaft 88 of which extends ahead of the support plate 86 positioned at right angles to the travelling direction of the slide plate 82. A plate member 89 is fixed to the outward extending portion of the rotatable drive device 87. The plate member 89 is fitted with a pair of horizontally parallel roller shafts 90, 91 which extend ahead of the plate member 89. One roller shaft 90 is provided concentrically with the rotary shaft 88 of the rotatable drive device 87. A wire stop plate 92 positioned on one side of a space between the roller shafts 90, 91 is fixed to the support plate 86 by a pair of shafts 93, 94. A wire guide plate 95 is provided in a manner to extend from the other side of a space between the roller shafts 93, 94 to the rotatable drive device 87. The top plane of the wire guide plate 95 is set flush with the upper peripheral portion of the lower roller shaft 91. The wire guide plate 95 is mounted on a support plate 86*a*. One end of the stationary plate 79 is provided with a stop member 96 to restrict the travelling range of the slide plate 82.

The spring leg 24' is brought down exactly on the wire guide plate 95. Thereafter when the cylinder 85 is driven, the slide plate 82 travels toward the stop member 96. The rotatable drive device 87 and roller shafts 90, 91 are also moved in the same direction jointly with the slide plate 82. Accordingly, the spring leg 24' is placed between the paired roller shafts 90, 91. The slide plate 82 is brought to rest by the stop member 96 with the end of the spring leg 24' pressed against the wire stop plate 92. Thereafter the rotatable drive device 87 is put into operation, causing the plate member 89 to rotate jointly with the rotary shaft 88 of said drive device 87. One roller shaft 90 concentrically disposed with the rotary shaft 88 rotates at a fixed position, whereas the other roller shaft 91 revolves, as shown by the arrow a, about said one roller shaft 90 while rotating. As the result, the spring leg 24' placed between the paired roller shafts 90, 91 is bent to provide a finished corner spring. The spring leg-bending mechanisms 23 constructed as described above are horizontally provided in pairs on both sides of the subject corner spring-manufacturing apparatus. Each spring leg-bending mechanism 23 is provided, as shown in FIG. 2, with a stop member 97. Upon completion of the bending, the spring leg 24' is released from the stop member 97 and the finished corner spring is gravitationally drawn out of the subject apparatus.

The corner spring thus fully bent is subjected, if necessary, to wax treatment in order to be rendered rust-proof. A wax treatment vessel 101 is constructed as illustrated, for example, in FIGS. 13 and 14. The wax treatment vessel 101 is positioned obliquely below the spring leg-bending mechanism 23. A corner spring brought down from the spring leg-bending mechanism 23 passes over a wire guide 98 and then guide plates 102 provided in the wax treatment vessel 101 and finally into a wax solution 103 received in said vessel 101. Referential numeral 104 denotes a stop plate for properly guiding the finished corner spring into the wax solution 103. The corner spring dipped in the wax solution 103 is drawn out therefrom by an endless chain 105 and carried to a transporter 106. The endless chain 105 is stretched across a pair of lower and upper sprocket wheels 107, 108, the former of which is placed in the wax solution and the latter of which is positioned outside of the wax treatment vessel 101. The endless chain 105 is further provided with a plurality of engagement attachments 109 arranged at a prescribed space. These engagement attachments 109 are intended to catch the corner spring for its removal from the wax solution 103. The upper sprocket wheel 108 is connected to the rotary shaft of a motor 112 through chains 110, 111. The motor 112 rotates the upper sprocket wheel 108 through the chains 110, 111, causing the endless chain 105 to travel. The corner spring which slid over the guide plates 102 into the wax solution 103 and was coated with wax is moved upward while being caught by the engagement attachments 109 and is removed from the wax treatment device at the upper sprocket wheel 108 to be delivered to the transporter 106.

With the corner spring-manufacturing apparatus of this invention, the spring leg-forming mechanism 21, heat treatment device 22, and spring leg-bending mechanism 23 are provided, as shown in FIG. 2, with a common wire guide plate 98 supporting the wire 24 at the center. Further, as indicated the paired spring leg-forming mechanisms 21 and paired heat treatment devices 22 are each provided with wire guide plates 99, 100 supporting the wire 24 at both ends like the wire guide plate 95 of the spring leg-bending mechanism 23. Therefore, the manufacturing apparatus of this invention enables the corner spring illustrated in FIG. 1 to be automatically formed of a wire 24.

What is claimed is:

1. A corner spring-manufacturing apparatus which comprises a pair of spring leg-forming mechanisms for folding both ends of a wire several times to provide spring legs at said ends; a pair of heat treatment devices for heat-treating the wire now having spring legs formed at both ends; and a pair of spring leg-bending mechanisms for bending the heat-treated spring legs.

2. An apparatus according to claim 1, wherein the paired spring leg-forming mechanisms are each formed of a plurality of wire-bending units; each said wire-bending unit comprises a central rotary shaft and a projection revolving around said central rotary shaft; and the wire is folded several times through a prescribed angle by being turned while being clamped between said central rotary shaft and projection.

3. An apparatus according to claim 2, wherein the central rotary shaft and projection are made free to move vertically and, when brought down, are disengaged from the wire.

4. An apparatus according to claim 2, wherein the wire folding unit has a wire-contacting shaft positioned close to the central rotary shaft to prevent the other portion of the wire than those which are folded from being strained.

5. An apparatus according to claim 2, wherein there is provided a wire-clamping device for tightly holding the intermediate part of the wire.

6. An apparatus according to claim 2, wherein three wire-folding units are linearly arranged in the axial direction of the wire on both sides of the apparatus so as to fold both ends of the wire.

7. An apparatus according to claim 1, wherein the spring leg-forming mechanism, heat treatment device and spring leg-bending mechanism provided on each side of the apparatus are arranged in a cascade fashion in the order mentioned, thereby enabling the wire which has been fully processed in one of said three processing divisions to be gravitationally brought down to another.

8. An apparatus according to claim 1, wherein there is provided a wire-feeding device for delivering a plurality of wires one after another to the foremost spring leg-forming mechanism.

9. An apparatus according to claim 1, wherein the heat treatment device holds both ends of a spring leg supplied thereto and introduces electric current therethrough for heat treatment.

10. An apparatus according to claim 1, wherein the spring leg-bending mechanism comprises a pair of upper and lower horizontally parallel rollers capable of being shifted in the axial direction of the wire, and allows a spring leg to be placed between said upper and lower rollers, one of which revolves around the other to bend the spring leg.

11. An apparatus according to claim 1, wherein there is provided a wax treatment device for applying wax on the spring leg which has been bent by the spring leg-bending mechanism.

* * * * *